US012540805B2

(12) United States Patent
Wales

(10) Patent No.: US 12,540,805 B2
(45) Date of Patent: Feb. 3, 2026

(54) REVERSE-SABOTED SIDEARM SYSTEMS, AND RELATED SIDEARMS, AMMUNITION, AND METHODS

(71) Applicant: Cameron Scott Wales, Lake St. Louis, MO (US)

(72) Inventor: Cameron Scott Wales, Lake St. Louis, MO (US)

( * ) Notice: Subject to any disclaimer, the term of this patent is extended or adjusted under 35 U.S.C. 154(b) by 159 days.

(21) Appl. No.: 18/402,179

(22) Filed: Jan. 2, 2024

(65) Prior Publication Data

US 2025/0093138 A1 Mar. 20, 2025

Related U.S. Application Data

(60) Provisional application No. 63/582,956, filed on Sep. 15, 2023.

(51) Int. Cl.
*F42B 14/06* (2006.01)
*F41A 21/12* (2006.01)
(Continued)

(52) U.S. Cl.
CPC ..... *F42B 14/064* (2013.01); *F41A 21/12* (2013.01); *F41A 21/18* (2013.01); *F42B 5/067* (2013.01); *F42B 8/10* (2013.01); *F42B 14/06* (2013.01)

(58) Field of Classification Search
CPC .... F42B 5/00; F42B 5/02; F42B 5/025; F42B 5/03; F42B 5/035; F42B 5/073;
(Continued)

(56) References Cited

U.S. PATENT DOCUMENTS 735,351 A * 8/1903 Dreger ..... F42B 5/26 102/464
2,654,318 A * 10/1953 Dunham ..... F42B 8/02 102/446

(Continued)

FOREIGN PATENT DOCUMENTS

CH 548584 A * 4/1974
CN 111089513 B 3/2022

(Continued)

OTHER PUBLICATIONS

Spuler. The Best Straight Walled AR Cartridges. <https://www.weapon-blog.com/2021/11/the-best-straight-walled-ar-cartridges/>. Nov. 30, 2021. (Year: 2021).*

(Continued)

*Primary Examiner* — Gabriel J. Klein
(74) *Attorney, Agent, or Firm* — McClure, Qualey & Rodack, LLP

(57) ABSTRACT

A representative reverse-saboted sidearm system includes: a sidearm having a barrel assembly with an inner wall defining a longitudinally extending bore; and a round of reverse-saboted ammunition having a non-necked casing, a reverse sabot, and a projectile, the reverse sabot mounted at a discharge end of the casing with a distal end of the reverse sabot extending outwardly from the casing, the reverse sabot exhibiting a diameter corresponding to a diameter of the casing and defining a receiving passage aligned with a longitudinal centerline of the casing, the projectile being at least partially disposed within the receiving passage of the reverse sabot; the inner wall of the barrel assembly being configured to engage an exterior surface of the projectile to direct the projectile.

13 Claims, 5 Drawing Sheets

(51) Int. Cl.
*F41A 21/18* (2006.01)
*F42B 5/067* (2006.01)
*F42B 8/10* (2006.01)

(58) Field of Classification Search
CPC .... F42B 8/02; F42B 8/10; F42B 14/06; F42B 14/064; F42B 10/34; F42B 10/36; F41A 21/10; F41A 21/12
See application file for complete search history.

(56) References Cited

U.S. PATENT DOCUMENTS 2,835,198 A * 5/1958 Brombacher ..... F42B 5/03 102/438
2,938,458 A * 5/1960 O'Brien ..... F42B 5/045 42/59
3,089,420 A * 5/1963 Littleford ..... F42B 5/26 102/470
3,412,681 A * 11/1968 Schirneker ..... F42B 5/035 89/14.05
3,433,157 A * 3/1969 Erich ..... F42B 8/10 102/513
3,862,600 A * 1/1975 Tocco ..... F42B 5/03 102/438
4,024,819 A 5/1977 Schirneker
4,212,244 A * 7/1980 Flatau ..... F42B 5/03 102/438
4,301,736 A * 11/1981 Flatau ..... F42B 10/34 102/501
4,384,528 A * 5/1983 Moore ..... F42B 12/44 102/503
4,393,782 A * 7/1983 Olsen ..... F42B 5/073 42/59
4,444,112 A * 4/1984 Strandli ..... F42B 12/06 102/518
4,457,093 A * 7/1984 Olsen ..... F42B 5/073 42/59
4,485,742 A * 12/1984 Mamo ..... F42B 5/02 102/503
4,572,078 A * 2/1986 Bell ..... F42C 19/0826 102/466
4,604,954 A 8/1986 Clarke
4,612,860 A * 9/1986 Flatau ..... F42B 12/06 102/501
4,803,927 A 2/1989 Washburn
4,939,997 A * 7/1990 Hoffman ..... F42B 5/03 102/517
5,067,407 A 11/1991 Martwick
5,069,137 A 12/1991 Martwick
5,173,571 A 12/1992 Montgomery
5,359,937 A * 11/1994 Dittrich ..... F42B 14/064 102/444
5,492,063 A * 2/1996 Dittrich ..... F42B 5/02 102/444
5,677,505 A * 10/1997 Dittrich ..... F42B 5/02 102/444
7,210,260 B1 * 5/2007 Smalley, Jr. ..... F42B 5/025 89/14.05
7,451,706 B2 11/2008 Meyer
7,455,015 B2 * 11/2008 Krstic ..... F42B 12/74 102/439
10,976,140 B2 4/2021 Wood
2002/0002925 A1 * 1/2002 Hsiung ..... F42B 5/02 102/498
2005/0016414 A1 * 1/2005 Leitner-Wise ..... F42B 5/025 102/522
2006/0011092 A1 * 1/2006 Mochak ..... F42B 14/06 102/522
2006/0162606 A1 * 7/2006 Meyer ..... F42B 7/02 102/521
2010/0300319 A1 * 12/2010 Guindon ..... F42B 5/16 149/93
2012/0192751 A1 * 8/2012 Lafortune ..... F42B 5/045 102/439
2014/0000471 A1 * 1/2014 Carpenter ..... F42B 5/045 102/439
2014/0261042 A1 * 9/2014 Imhoff ..... F42B 5/03 102/438
2016/0238361 A1 * 8/2016 Rachlin ..... F41A 1/02
2019/0041175 A1 * 2/2019 Fellows ..... F42B 14/061
2020/0025533 A1 * 1/2020 Shipley ..... F41A 9/70
2020/0378707 A1 * 12/2020 Shipley ..... F41A 21/12

FOREIGN PATENT DOCUMENTS

DE 10007675 A1 * 11/2001 ..... F42B 10/34
EP 0485066 A1 * 5/1992 ..... F42B 5/00
FR 2771806 A1 * 6/1999 ..... F42B 10/34
WO WO-0227262 A2 * 4/2002 ..... F42B 5/18
WO WO-2006077251 A1 * 7/2006 ..... F42C 19/0834
WO WO-2015175112 A2 * 11/2015 ..... F42C 15/24
WO WO-2018083680 A1 * 5/2018 ..... F42B 5/28

OTHER PUBLICATIONS

Machine Translation of DE 10007675 A1. Tunger. Nov. 8, 2001. (Year: 2001).*

* cited by examiner

REVERSE-SABOTED SIDEARM SYSTEMS, AND RELATED SIDEARMS, AMMUNITION, AND METHODS

CROSS REFERENCE TO RELATED APPLICATION

This utility application claims the benefit of and priority to U.S. Provisional Application 63/582,956, filed on 15 Sep. 2023, which is incorporated herein by reference in its entirety.

BACKGROUND

Technical Field

The disclosure generally relates to sidearms and ammunition for sidearms.

Description of the Related Art

To increase bullet velocity while using a limited case volume, modern metallic cartridges are bottlenecked; they have a bullet diameter significantly smaller than the maximum diameter of the casing. This inevitably creates cartridges that operate at relatively high pressure with an elongated geometry, making them unsuitable for use in concealable sidearms.

One way to fire a small, high velocity round without using a bottlenecked cartridge is to use a sabot. A sabot is a device that nests around a projectile and keeps it aligned in the center of the barrel when fired. A sabot allows for the use of a small caliber projectile with a large straight-walled casing that would ordinarily fire a larger diameter projectile at a lower velocity. Once the sabot carries the projectile down the barrel, it discards from the bullet.

Saboted projectiles have proven utility but have several perceived drawbacks. For example, saboted projectiles are limited in their accuracy, as the projectile never engages with barrel rifling as the projectile travels down the barrel. Additionally, saboted projectiles suffer from efficiency loss, as energy must be expended in pushing the discarding sabot down the barrel.

SUMMARY

In this regard, reverse-saboted sidearm systems, and related sidearms, ammunition, and methods are provided. An example embodiment of a reverse-saboted sidearm system, comprises: a sidearm having a barrel assembly with an inner wall defining a longitudinally extending bore; and a round of reverse-saboted ammunition having a non-necked casing, a reverse sabot, and a projectile, the reverse sabot mounted at a discharge end of the casing with a distal end of the reverse sabot extending outwardly from the casing, the reverse sabot defining a receiving passage aligned with a longitudinal centerline of the casing, the projectile being at least partially disposed within the receiving passage of the reverse sabot; the inner wall of the barrel assembly being configured to engage an exterior surface of the projectile to direct the projectile.

In at least one embodiment, the casing extends from a striking end to a discharge end, the casing defining an interior, the discharge end having an aperture defining an opening, the opening communicating with the interior.

In at least one embodiment, the system further comprises: propellant disposed within the interior; and a primer mounted at the striking end of the casing, the primer being operative to ignite the propellant.

In at least one embodiment: a first portion of the reverse sabot extends into the opening and the interior; a second portion of the reverse sabot extends outwardly from the discharge end of the casing; the receiving passage extends through the reverse sabot from a proximal end of the first portion to a distal end of the second portion; and the casing, the primer, the reverse sabot, and the projectile encase the propellant.

In at least one embodiment: the reverse sabot is a first bullet of a caliber configured for use with the casing; and the receiving passage is formed through the first bullet.

In at least one embodiment, the projectile is a second bullet of a smaller caliber than the caliber of the first bullet.

In at least one embodiment, the projectile is a 5.56 mm NATO (rifle) bullet and the first bullet is a 10 mm auto (pistol) bullet.

In at least one embodiment: the projectile has a proximal end and a distal end; and the distal end of the projectile does not extend beyond the distal end of the reverse sabot.

In at least one embodiment, the proximal end of the projectile does not extend beyond the proximal end of the reverse sabot.

In at least one embodiment, the reverse sabot is configured to remain mounted to the casing after firing of the round, during which the projectile is expelled from the reverse sabot.

In at least one embodiment, the receiving passage is an axial bore formed through the reverse sabot.

In at least one embodiment: along a length of the receiving passage, the receiving passage varies in diameter; and an inner surface of the reverse sabot defining the receiving passage at a narrowed portion thereof engages an exterior portion of the projectile to mount the projectile to the reverse sabot.

In at least one embodiment: along a length of the receiving passage, the receiving passage varies in diameter, with an intermediate portion of the receiving passage exhibiting a narrowed diameter; and an inner surface of the reverse sabot defining the intermediate portion of the receiving passage engages an exterior portion of the projectile to mount the projectile to the reverse sabot.

In at least one embodiment, the inner surface is toroidal in shape.

In at least one embodiment, the casing has a circumferential extraction groove disposed adjacent to the striking end.

In at least one embodiment, the inner wall of the barrel assembly exhibits rifling to impart rotation to the projectile while being propelled through the bore.

An example embodiment of a reverse-saboted ammunition round comprises: a casing exhibiting a non-necked cylindrical exterior extending from a striking end to a discharge end, the casing defining an interior, the discharge end having an aperture defining an opening, the opening communicating with the interior; propellant disposed within the interior; a primer mounted at the striking end of the casing, the primer being operative to ignite the propellant; a reverse sabot mounted at the discharge end of the casing, with a first portion of the reverse sabot extending into the opening and the interior, and a second portion of the reverse sabot extending outwardly from the discharge end of the casing, the reverse sabot exhibiting a diameter corresponding to a diameter of the opening of the casing and defining a receiving passage aligned with a longitudinal centerline of the casing, the receiving passage extending through the reverse sabot from a proximal end of the first portion to a distal end of the second portion; and a projectile disposed at least partially within the receiving passage of the reverse sabot; the casing, the primer, the reverse sabot, and the projectile encasing the propellant.

In at least one embodiment: the reverse sabot is a first bullet of a caliber configured for use with the casing; and the receiving passage is formed through the first bullet.

In at least one embodiment, the projectile is a second bullet of a smaller caliber than the caliber of the first bullet.

In at least one embodiment, the projectile is a 5.56 mm NATO (rifle) bullet and the first bullet is a 10 mm auto (pistol) bullet.

In at least one embodiment: the projectile has a proximal end and a distal end; and the distal end of the projectile does not extend beyond the distal end of the reverse sabot.

In at least one embodiment, the proximal end of the projectile does not extend beyond the proximal end of the reverse sabot.

In at least one embodiment, the reverse sabot is configured to remain mounted to the casing after firing of the round, during which the projectile is expelled from the reverse sabot.

In at least one embodiment, the receiving passage is an axial bore formed through the reverse sabot.

In at least one embodiment: along a length of the receiving passage, the receiving passage varies in diameter; and an inner surface of the reverse sabot defining the receiving passage at a narrowed portion thereof engages an exterior portion of the projectile to mount the projectile to the reverse sabot.

In at least one embodiment: along a length of the receiving passage, the receiving passage varies in diameter, with an intermediate portion of the receiving passage exhibiting a narrowed diameter; and an inner surface of the reverse sabot defining the intermediate portion of the receiving passage engages an exterior portion of the projectile to mount the projectile to the reverse sabot.

In at least one embodiment, the inner surface is toroidal in shape.

In at least one embodiment, the casing has a circumferential extraction groove disposed adjacent to the striking end.

An example embodiment of a sidearm for use with reverse-saboted ammunition, a round of the reverse-saboted ammunition having a non-necked casing, a reverse sabot, and a projectile, the reverse sabot mounted at a discharge end of the casing, the reverse sabot exhibiting a diameter corresponding to a diameter of the casing and defining a receiving passage therethrough aligned with a longitudinal centerline of the casing, the projectile being at least partially disposed within the receiving passage of the reverse sabot, the sidearm comprises: a barrel assembly having an inner wall defining a bore extending longitudinally along a length of the barrel assembly, the bore exhibiting a diameter corresponding to the diameter of the projectile of a round of reverse-saboted ammunition and narrower than the diameter of the reverse sabot, the inner wall being configured to engage an exterior surface of the projectile to impart a rotation to the projectile while being propelled through the barrel assembly.

In at least one embodiment, the sidearm further comprises a chamber extending from a breech to a bore end, the breech being sized and shaped to receive the round of reverse-saboted ammunition, the chamber communicating with the bore and aligning the projectile with the bore.

In at least one embodiment: a portion of the reverse sabot extends outwardly from the casing; and in a chambered position of the round, an exterior surface of the portion of the reverse sabot that extends outwardly from the casing engages an inner surface disposed at the bore end of the chamber.

In at least one embodiment, in a chambered position of the round, the projectile of the round does not extend into the bore of the barrel assembly.

An example embodiment of a method for producing reverse-saboted ammunition, comprises: providing a casing exhibiting a non-necked cylindrical exterior extending from a striking end to a discharge end, the casing defining an interior, the discharge end having an aperture defining an opening, the opening communicating with the interior; mounting a primer at the striking end of the casing; disposing propellant within the interior; mounting a reverse sabot at the discharge end of the casing, with a first portion of the reverse sabot extending through the opening and into the interior, and a second portion of the reverse sabot extending outwardly from the discharge end of the casing, the reverse sabot defining a receiving passage aligned with a longitudinal centerline of the casing, the receiving passage extending through the reverse sabot from a proximal end of the first portion to a distal end of the second portion; and disposing a projectile at least partially within the receiving passage of the reverse sabot, wherein the casing, the primer, the reverse sabot, and the projectile encase the propellant.

In at least one embodiment: the reverse sabot is a first bullet of a caliber configured for use with the casing; and the method further comprises forming the receiving passage through the first bullet.

An example embodiment of a method for providing a sidearm for use with reverse-saboted ammunition comprises: providing a barrel assembly configured for use with reverse-saboted ammunition; and installing the barrel assembly in a sidearm.

In at least one embodiment, the method further comprises removing a barrel assembly, which was originally provided with the sidearm, and replacing the originally provided barrel assembly with the barrel assembly configured for use with reverse-saboted ammunition.

Other objects, features, and/or advantages will become apparent from the following detailed description of the preferred but non-limiting embodiments. The following description is made with reference to the accompanying drawings.

BRIEF DESCRIPTION OF THE DRAWINGS

Non-limiting and non-exhaustive embodiments are described with reference to the following drawings. In the drawings, like reference numerals refer to like parts throughout the various figures unless otherwise specified. These drawings are not necessarily drawn to scale. Likewise, the relative sizes of elements illustrated by the drawings may differ from the relative sizes depicted.

The disclosure can be more fully understood by the subsequent detailed description and examples with reference made to the accompanying drawings.

DETAILED DESCRIPTION

For ease in explanation, the following discussion describes several embodiments of reverse-saboted sidearm systems, and related sidearms, ammunition, and methods. It is to be understood that the invention is not limited in its application to the details of the arrangements shown since the invention is capable of other embodiments. Also, the terminology used herein is for the purpose of description and not of limitation.

Reference throughout this specification to "one embodiment", "an embodiment", "one example", and/or "an example" (or language similar thereto) means that a particular feature, structure, and/or characteristic described in connection with the embodiment or example is included in at least one embodiment. Thus, appearances of the phrases "in one embodiment", "in an embodiment", "one example", and/or "an example" in various places throughout this specification are not necessarily all referring to the same embodiment or example. Furthermore, the feature(s), structure(s), and/or characteristic(s) may be combined in any suitable combination(s) and/or sub-combination(s) in one or more embodiments or examples.

Figure 1:
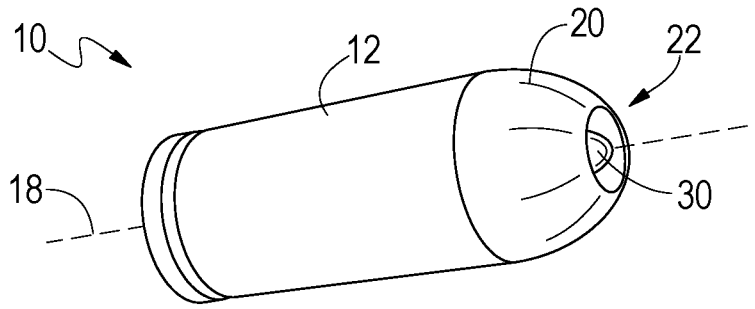
FIG. 1 is a schematic diagram of an exemplary embodiment of a round of reverse-saboted ammunition.
Figure 2:
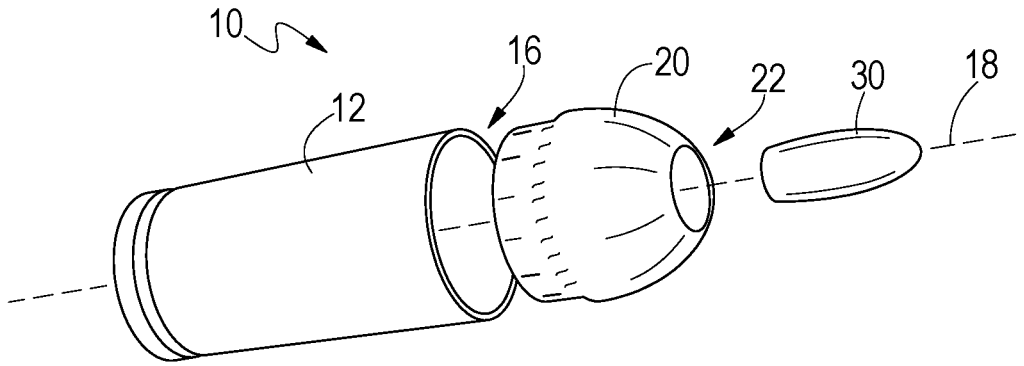
FIG. 2 is a partially exploded, schematic diagram of the embodiment of FIG. 1.

In this regard, FIGS. 1 and 2 depict an exemplary embodiment of a round of reverse-saboted (or, alternatively, "saboted") ammunition 10. Round 10 incorporates a casing 12 that is generally cylindrical and of uniform diameter (i.e., non-necked) along its length. A reverse sabot (or, alternatively, "sabot") 20 is mounted at a discharge end 16 of casing 12. Reverse sabot 20 exhibits a diameter corresponding to a diameter of casing 12. Reverse sabot 20 defines a receiving passage 22 that extends therethrough and is aligned with a longitudinal centerline 18 of casing 12. A projectile 30 is disposed at least partially within receiving passage 22 of reverse sabot 20.

In operation, reverse sabot 20 retains projectile 30 until firing in a corresponding sidearm. During the firing sequence of round 10, pressure builds within the casing until a retention force exerted on projectile 30 by reverse sabot 20 is exceeded. The pressure then forces projectile 30 from receiving passage 22 and outwardly from reverse sabot 20. Reverse sabot 20 is retained by casing 12, even after projectile 30 is expelled from the sidearm.

Figure 3:
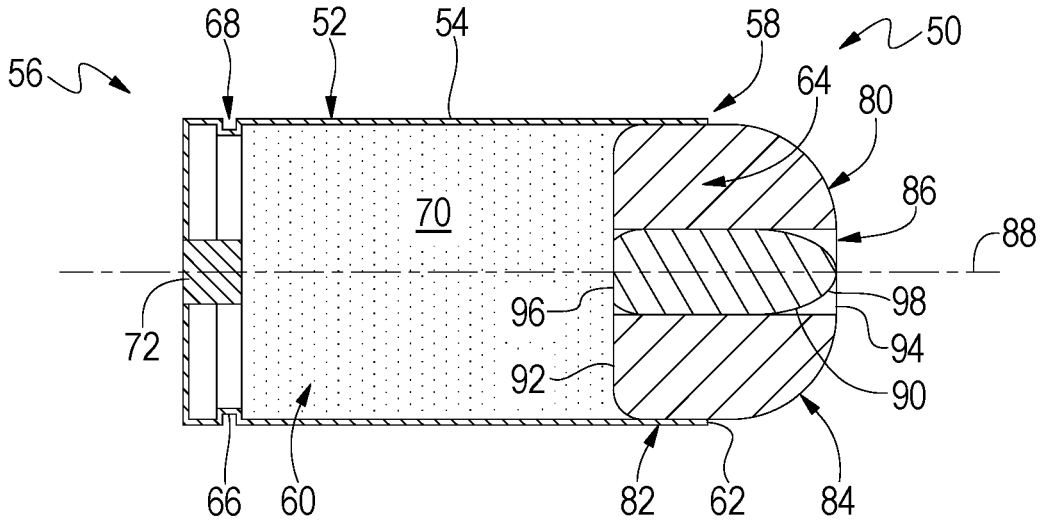
FIG. 3 is a cross-sectional, schematic diagram of another exemplary embodiment of a round of reverse-saboted ammunition.

Another exemplary embodiment of a round of reverse-saboted ammunition 50 is depicted in FIG. 3. Round 50 includes a casing 52 incorporating a non-necked cylindrical exterior 54 that extends from a striking end 56 to a discharge end 58. Casing 52 defines an interior 60. An aperture 62 is disposed at discharge end 58 that defines an opening 64. Opening 64 communicates with and provides access to interior 60. Additionally, a circumferential channel 66 that defines an extraction groove 68 is disposed adjacent to striking end 56.

Round 50 also includes propellant 70 (e.g., black powder) that is disposed within interior 60. A primer 72 is mounted at striking end 56 of casing 52. Primer 72 is used to ignite propellant 70 in response to being struck, such as by a firing pin of a sidearm (not shown).

A reverse sabot 80 is mounted at discharge end 58 of casing 52. A first portion 82 of reverse sabot 80 extends through opening 64 and into interior 62, and a second portion 84 of reverse sabot 80 extends outwardly from discharge end 58 of casing 52. Notably, at least first portion 82 of reverse sabot 80 exhibits a diameter corresponding to a diameter of opening 64 to facilitate mounting of reverse sabot 80 to casing 52. Reverse sabot 80 defines a receiving passage 86 that is aligned with a longitudinal centerline 88 of casing 52. Receiving passage 86 extends through reverse sabot 80 from a proximal end 92 of first portion 82 to a distal end 94 of second portion 84.

A projectile 90 is disposed at least partially within receiving passage 86 so that casing 52, primer 72, reverse sabot 80, and projectile 90 encase propellant 70. In at least one embodiment, this encasement provides a hermetic seal about the propellant. Projectile 90 extends between a proximal end 96 and a distal end 98. As shown in the embodiment of FIG. 3, proximal end 96 of projectile 90 does not extend beyond (e.g., terminates at) proximal end 92 of reverse sabot 80, and distal end 98 of projectile 90 does not extend beyond (e.g., terminates at) distal end 94 of reverse sabot 80. In other embodiments, the proximal end of a projectile may extend beyond the proximal end of the associated reverse sabot (i.e., farther into the interior of the casing). Also note that, in the embodiment of FIG. 3, receiving passage 86 is configured as an axial bore formed through reverse sabot 80. In other embodiments (such the example of FIG. 4), other configurations of receiving passages may be used.

Various configurations of reverse sabots may be used provided that each is able to retain a corresponding projectile until firing. By way of example, in at least one embodiment, a reverse sabot may be formed from a preformed bullet of a caliber that is configured for use with a desired casing. A receiving passage may be formed through the bullet.

Various configurations of projectiles also may be used. By way of example, in at least one embodiment, a projectile may be formed from a preformed bullet of a caliber that is suitable for use with a receiving passage. This may include the projectile being a second bullet of a smaller caliber than the caliber of the bullet used in forming the reverse sabot. For instance, a projectile may be a 5.56 mm NATO (rifle) bullet and a reverse sabot may be formed using a 10 mm auto (pistol) bullet.

Figure 4:
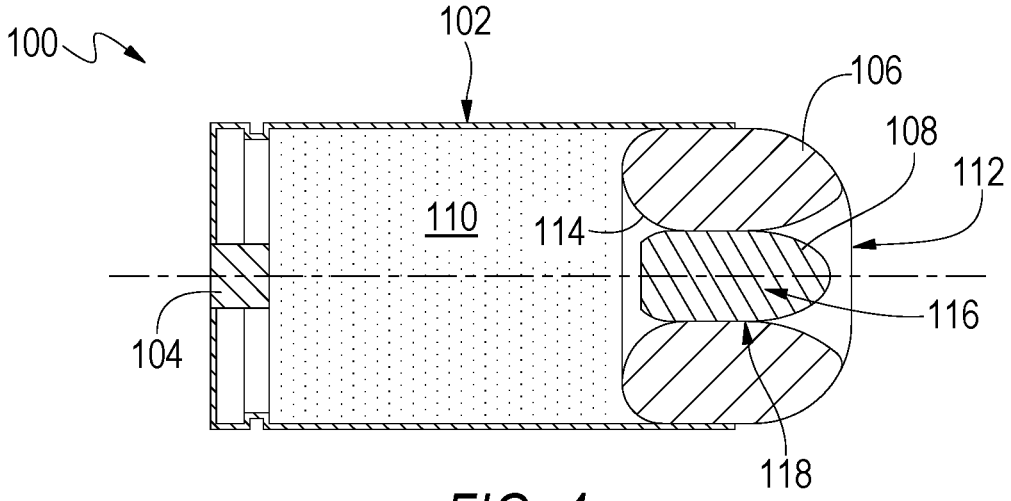
FIG. 4 is a cross-sectional, schematic diagram of another exemplary embodiment of a round of reverse-saboted ammunition.

Another exemplary embodiment of a round of reverse-saboted ammunition 100 is depicted in FIG. 4. Round 100 includes a casing 102, a primer 104, a reverse sabot 106, and a projectile 108 that are used to encase propellant 110 in a manner similar to that described before. However, unlike the embodiment of FIG. 3, reverse sabot 106 incorporates a receiving passage 112 that does not exhibit a uniform diameter along its length. An inner surface 114 that defines receiving passage 112 includes a narrowed portion (i.e., a portion with a narrowed diameter) that is configured to engage an exterior portion 116 of projectile 108 to mount projectile 108 to reverse sabot 106. As shown in the non-limiting example of FIG. 4, an intermediate portion 118 along a length of receiving passage 112 exhibits the narrowed diameter. Such a configuration may be provided variously; however, in the embodiment of FIG. 4, the configuration is provided by inner surface 114 being toroidal in shape. So configured, inner surface 114 is in direct contact about a circumference of projectile 108.

Figure 5:
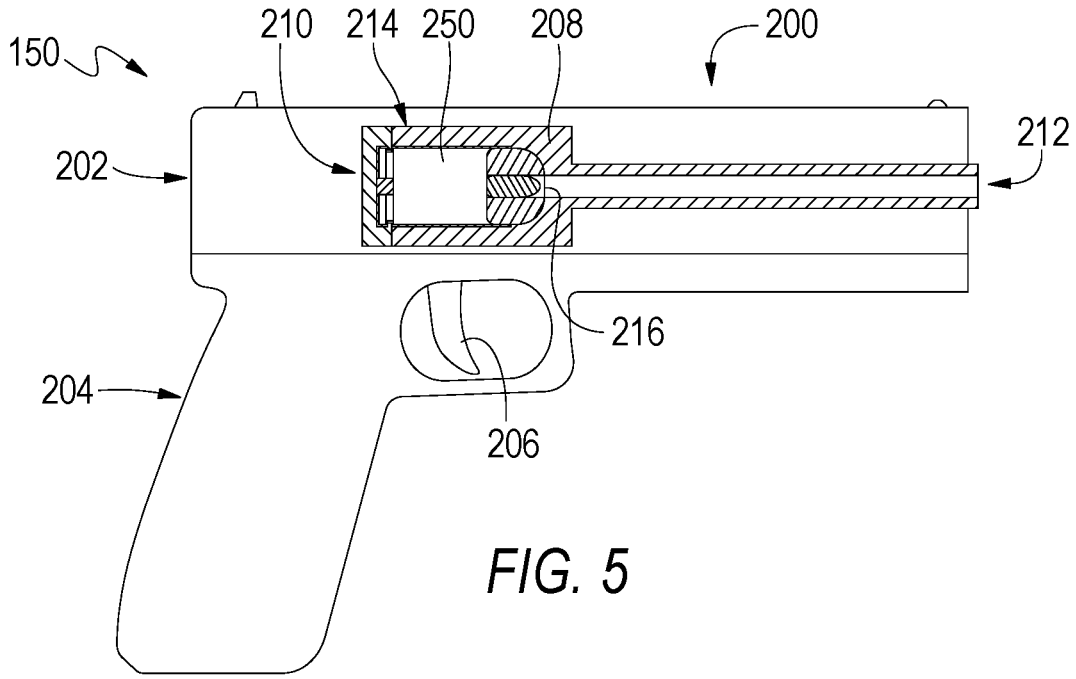
FIG. 5 is a schematic diagram of an exemplary embodiment of a sidearm showing an exemplary embodiment of round of reverse-saboted ammunition in a chambered position prior to discharge.

An exemplary embodiment of a sidearm system will now be described with reference to FIGS. 5-8. As shown in FIG. 5, sidearm system 150 includes an exemplary embodiment of a sidearm 210 as well as an exemplary embodiment of a round of reverse-saboted ammunition 250. Sidearm 200 is a semi-automatic sidearm that is conventional in many respects as will be readily understood by one of ordinary skill in the art; therefore, various aspects are not described in detail. For instance, sidearm 200 may be based on a GLOCK® 20 10 mm handgun by way of non-limiting example. Regardless, sidearm 200 incorporates a frame 202 and a slide 204, which moves relative to frame 202 in response to discharge of a round of ammunition for expelling the discharged round and registering a subsequent round for firing. Frame 202 mounts a trigger assembly 206 that is actuated by a user to initiate a firing sequence that involves a firing pin (not shown) striking the primer of a chambered round of ammunition.

Sidearm 200 also incorporates a barrel assembly 208, which extends from a breech 210 to a muzzle 212. Barrel assembly 208 includes a chamber 214 that extends between breech 210 and a bore end 216. In at least one embodiment, barrel assembly 208 is formed as an integrated component; however, a multi-piece design may be used. For instance, a barrel assembly may be formed from a barrel and a barrel extender (not shown). Round 250 is shown in FIG. 5 in a chambered position within chamber 214.

Figure 7:
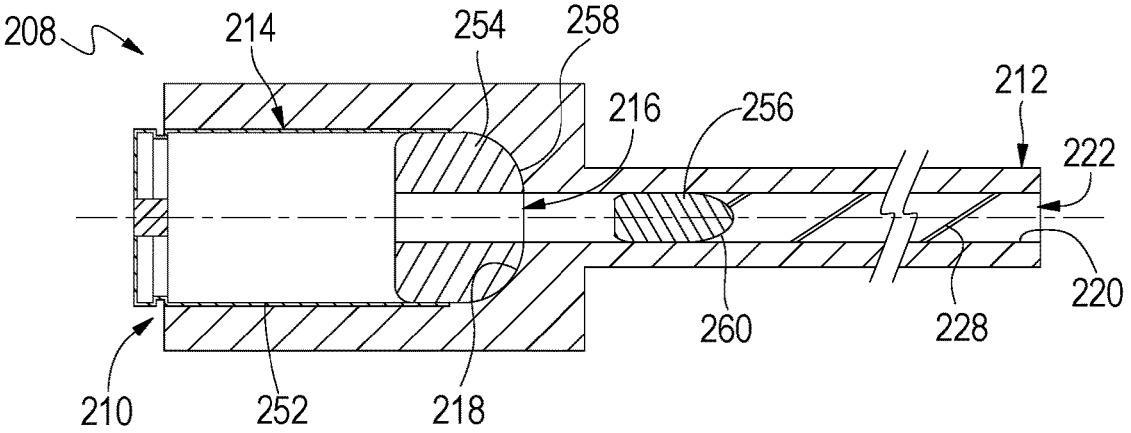
FIG. 7 is a schematic diagram of the exemplary embodiment of FIGS. 5 and 6 showing detail of the barrel assembly.
Figure 8:
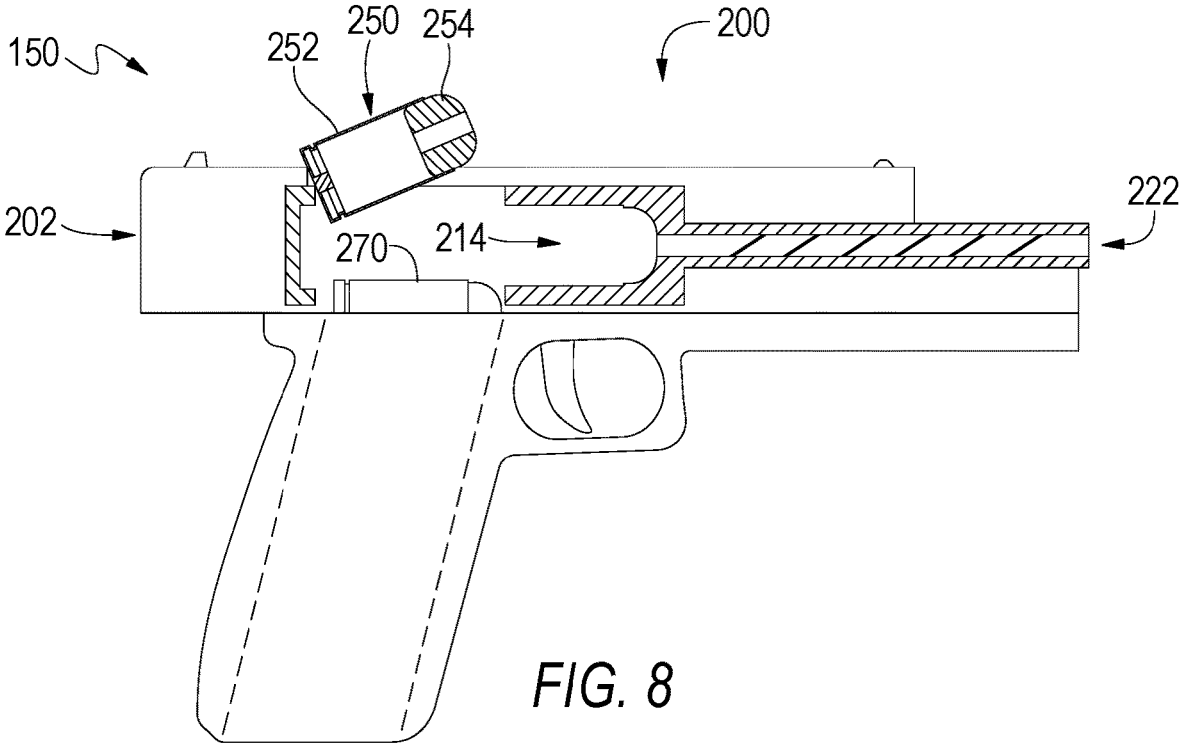
FIG. 8 is a schematic diagram of the exemplary embodiment of FIGS. 5-7 showing ejection of the cartridge from the sidearm after the round is discharged.

As best shown in FIG. 7, round 250 incorporates a non-necked casing 252, a reverse sabot 254, and a projectile 256 (among other possible features previously described that will not be described again here for brevity). Chamber 214 originates at breech 210, extends toward muzzle 214, and terminates at bore end 216 at a length that is selected to accommodate seating of round 250. Breech 210 communicates with and provides access to chamber 214; thus, breech 210 is sized and shaped to receive round 250 during chambering. In the chambered position of round 250, an exterior surface 258 of reverse sabot 254, which extends outwardly from casing 252, engages an inner surface 218 of chamber 214 disposed at bore end 216. This engagement seats round 250 in chamber 214 in preparation for firing.

Additionally, barrel assembly 208 incorporates an inner wall 220 that defines a bore 222. Bore 222 extends longitudinally along a length of barrel assembly 208 and exhibits a centerline 224 that is aligned with a centerline 226 of chamber 214. In the depicted embodiment, bore 222 communicates with chamber 214 and extends from bore end 216 to muzzle 212. So configured, chamber 214 aligns projectile 256 with bore 222 prior to firing, noting that projectile 256 does not enter bore 222 until after round 250 is discharged (see, FIGS. 6 and 7, for example).

Bore 222 exhibits a diameter that is narrower than the diameter of reverse sabot 254 and chamber 214—a diameter that corresponds to the diameter of projectile 256. In the depicted embodiment, inner wall 220 is configured to engage an exterior surface 260 of projectile 256 while being propelled through bore 222. In at least one embodiment, inner wall 220 incorporates rifling 228 (FIG. 7) to impart rotation to projectile 256 while projectile 256 is propelled through bore 222.

It should be noted that, in at least one embodiment, a barrel assembly is provided as a replacement component for a sidearm that was not originally manufactured for chambering and firing reverse-saboted ammunition. By way of non-limiting example, the barrel assembly of a 10 mm sidearm (i.e., a sidearm configured to chamber and fire a 10 mm bullet) may be replaced with a barrel assembly (such as barrel assembly 208) that is configured to receive 10 mm ammunition but includes a bore of a diameter that is too small to direct a 10 mm bullet. The bore, however, is sized to direct a projectile of an appropriately configured round of reverse-saboted ammunition. As such, an example embodiment of a method for providing a sidearm for use with reverse-saboted ammunition includes: providing a barrel assembly configured for use with reverse-saboted ammunition; and, installing the barrel assembly in a sidearm. As mentioned, this may include replacing a barrel assembly that was originally provided with the sidearm.

Returning to FIG. 5, round 250 is in a chambered position prepared for firing; that is, round 220 is received within chamber 216 with slide 202 forward so that breech face 230, which is carried by slide 202, engages the striking end of round 250. Note that, in the chambered position, projectile 256 does not extend into bore 222.

Figure 6:
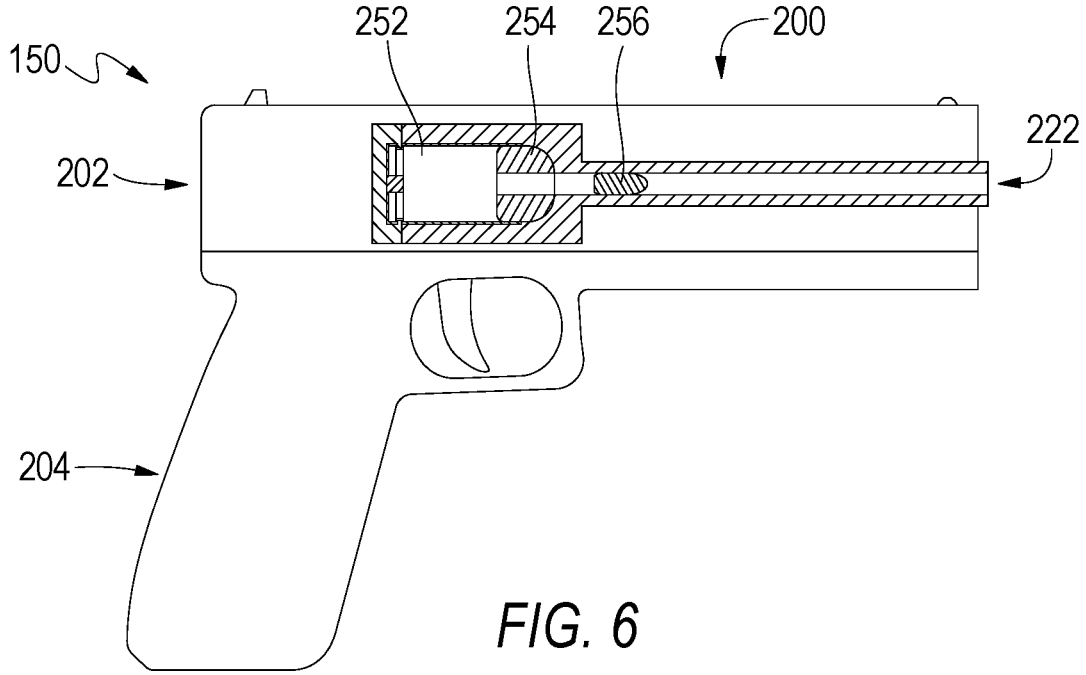
FIG. 6 is a schematic diagram of the exemplary embodiment of FIG. 5 showing the projectile of the round of reverse-saboted ammunition traveling through the bore after the round is discharged.

In FIG. 6, round 250 is discharged, which causes projectile 256 to be expelled from reverse sabot 254 and propelled through bore 222. Force generated during discharge also urges slide 202 rearward (see, FIG. 8), which extracts (the now discharged) round 250 from chamber 214 and ejects round 250 from sidearm 200. Note that reverse sabot 254 remains mounted to casing 252 with a non-deformed exterior as round 250 is ejected, even though projectile 256 has been expelled from reverse sabot 254. Although not depicted, a biasing force (typically provided by a spring) is used to drive slide 202 forward to the position shown in FIG. 5. During this forward movement, slide 202 strips a subsequent round 270 (if available) from an engaged magazine and directs round 270 into chamber 214.

Figure 9:
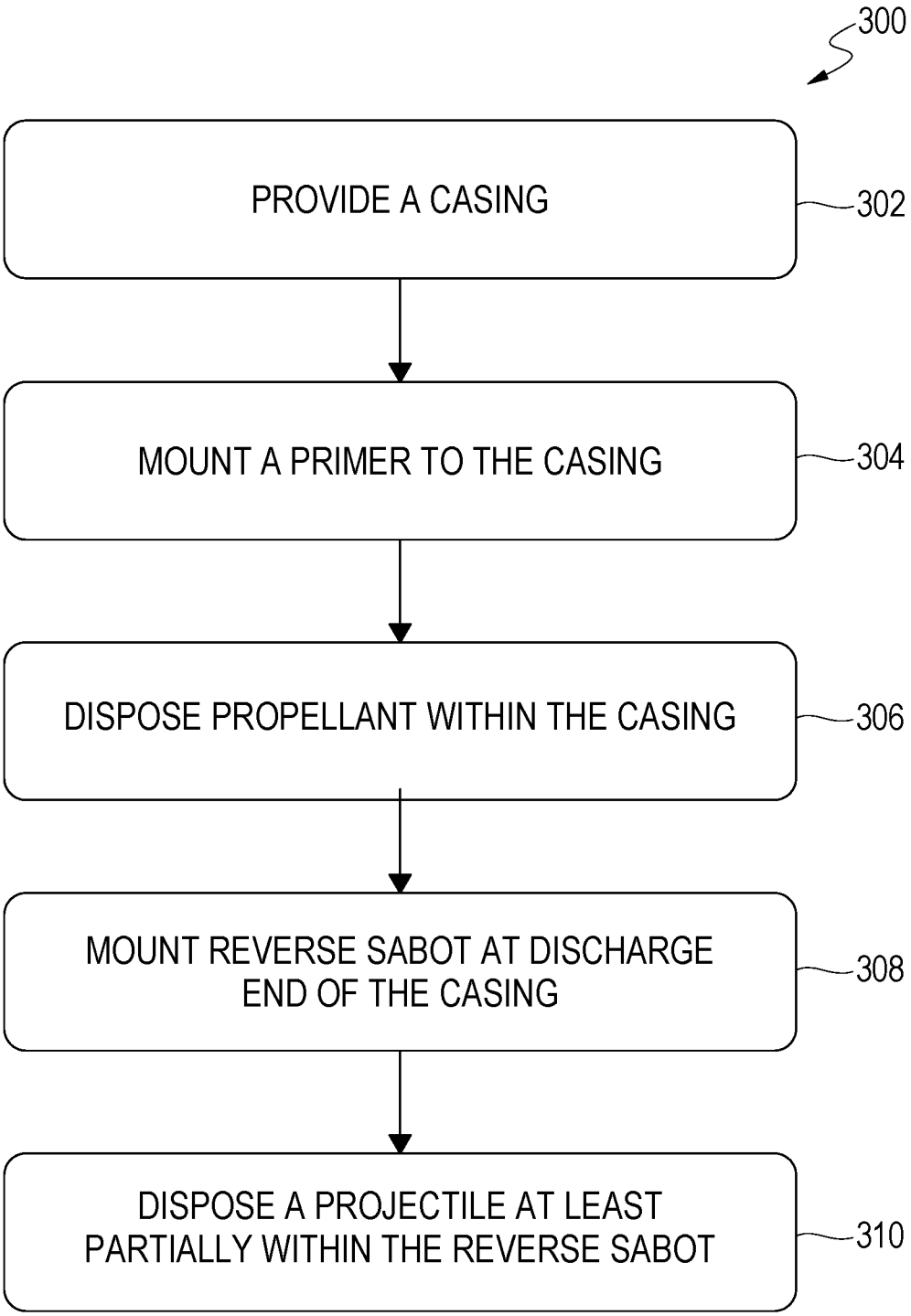
FIG. 9 is a flowchart depicting an exemplary embodiment of a method for producing reverse-saboted ammunition.

FIG. 9 is a flowchart depicting an exemplary embodiment of a method for producing reverse-saboted ammunition. As shown, method 300 may be construed as beginning at block 302, in which a casing exhibiting a non-necked cylindrical exterior is provided. Such a casing extends from a striking end to a discharge end, with the casing defining an interior. The discharge end of the casing incorporates an aperture that defines an opening, and the opening communicates with the interior.

In block 304, a primer is mounted at the striking end of the casing. Then, as shown in block 306, propellant is disposed within the interior of the casing.

In block 308, a reverse sabot is mounted at the discharge end of the casing. In particular, the reverse sabot is mounted so that a first portion extends through the opening and into the interior of the casing, and a second portion extends outwardly from the discharge end of the casing. Notably, the reverse sabot defines a receiving passage that is configured to receive a projectile. In at least one embodiment, the reverse sabot is formed from a preformed bullet of a caliber configured for use with the casing. The receiving passage may be formed in various manners, such as by forming (e.g., drilling) an axial bore through the material of the body of the reverse sabot.

In block 310, a projectile is at least partially disposed within the receiving passage of the reverse sabot so that the casing, the primer, the reverse sabot, and the projectile encase the propellant. In at least one embodiment, a pressing tool may be used to urge the projectile (back-end first) into the receiving passage.

In at least one embodiment, conventional cartridge manufacturing equipment may be used for many (if not all) of the steps used in forming reverse-saboted ammunition.

The embodiments described above are illustrative of the invention and it will be appreciated that various permutations of these embodiments may be implemented consistent with the scope and spirit of the invention as defined by the claims. Any examples provided are non-limiting examples.

I claim:

1. A sidearm system, comprising:

a sidearm having a barrel assembly with an inner wall defining a longitudinally extending bore; and a round of saboted ammunition having a non-necked casing, a sabot, and a projectile, the sabot mounted at a discharge end of the casing with a distal end of the sabot extending outwardly from the casing, the sabot defining a receiving passage aligned with a longitudinal centerline of the casing, the projectile being at least partially disposed within the receiving passage of the sabot;

the inner wall of the barrel assembly being configured to engage an exterior surface of the projectile to direct the projectile;

wherein:

the sabot is a first bullet of a caliber configured for use with the casing;

the receiving passage is formed through the first bullet;

the projectile is a second bullet of a smaller caliber than the caliber of the first bullet;

the projectile is a 5.56 mm NATO rifle bullet; and the first bullet is a 10 mm auto pistol bullet.

2. The sidearm system of claim 1, wherein:

the casing extends from a striking end to a discharge end, the casing defining an interior, the discharge end having an aperture defining an opening, the opening communicating with the interior; and the system further comprises:

propellant disposed within the interior; and a primer mounted at the striking end of the casing, the primer being operative to ignite the propellant.

3. The saboted sidearm system of claim 2, wherein:

a first portion of the sabot extends into the opening and the interior;

a second portion of the sabot extends outwardly from the discharge end of the casing;

the receiving passage extends through the sabot from a proximal end of the first portion to a distal end of the second portion; and the casing, the primer, the sabot, and the projectile encase the propellant.

4. The sidearm system of claim 1, wherein:

the projectile has a proximal end and a distal end; and the distal end of the projectile does not extend beyond the distal end of the sabot.

5. The saboted sidearm system of claim 4, wherein the proximal end of the projectile does not extend beyond the proximal end of the sabot.

6. The reverse-sabeted sidearm system of claim 1, wherein the sabot is configured to remain mounted to the casing after firing of the round, during which the projectile is expelled from the sabot.

7. The saboted sidearm system of claim 1, wherein the receiving passage is an axial bore formed through the sabot.

8. The saboted sidearm system of claim 1, wherein:

along a length of the receiving passage, the receiving passage varies in diameter; and an inner surface of the sabot defining the receiving passage at a narrowed portion thereof engages an exterior portion of the projectile to mount the projectile to the sabot.

9. The sidearm system of claim 1, wherein:

along a length of the receiving passage, the receiving passage varies in diameter, with an intermediate portion of the receiving passage exhibiting a narrowed diameter; and an inner surface of the sabot defining the intermediate portion of the receiving passage engages an exterior portion of the projectile to mount the projectile to the sabot.

10. The saboted sidearm system of claim 9, wherein the inner surface is toroidal in shape.

11. The saboted sidearm system of claim 1, wherein the casing has a circumferential extraction groove disposed adjacent to the striking end.

12. The saboted sidearm system of claim 1, wherein the inner wall of the barrel assembly exhibits rifling to impart rotation to the projectile while being propelled through the bore.

13. A saboted ammunition round, comprising:

a casing exhibiting a non-necked cylindrical exterior extending from a striking end to a discharge end, the casing defining an interior, the discharge end having an aperture defining an opening, the opening communicating with the interior;

propellant disposed within the interior;

a primer mounted at the striking end of the casing, the primer being operative to ignite the propellant;

a sabot mounted at the discharge end of the casing, with a first portion of the sabot extending into the opening and the interior, and a second portion of the sabot extending outwardly from the discharge end of the casing, the sabot exhibiting a diameter corresponding to a diameter of the opening of the casing and defining a receiving passage aligned with a longitudinal centerline of the casing, the receiving passage extending through the sabot from a proximal end of the first portion to a distal end of the second portion; and a projectile disposed at least partially within the receiving passage of the sabot;

the casing, the primer, the sabot, and the projectile encasing the propellant;

wherein:

the sabot is a first bullet of a caliber configured for use with the casing;

the receiving passage is formed through the first bullet;

the projectile is a second bullet of a smaller caliber than the caliber of the first bullet;

the projectile is a 5.56 mm NATO rifle bullet; and the first bullet is a 10 mm auto pistol bullet.

* * * * *